US007726441B2

(12) United States Patent
Uryu et al.

(10) Patent No.: US 7,726,441 B2
(45) Date of Patent: Jun. 1, 2010

(54) ACOUSTIC VIBRATORY PLATE

(75) Inventors: Masaru Uryu, Chiba (JP); Yoshio Ohashi, Kanagawa (JP); Kunihiko Tokura, Tokyo (JP)

(73) Assignee: Sony Corporation, Tokyo (JP)

( * ) Notice: Subject to any disclaimer, the term of this patent is extended or adjusted under 35 U.S.C. 154(b) by 27 days.

(21) Appl. No.: 11/392,603

(22) Filed: Mar. 30, 2006

(65) Prior Publication Data

US 2006/0222202 A1 Oct. 5, 2006

(30) Foreign Application Priority Data

Apr. 5, 2005 (JP) ..... 2005-109032

(51) Int. Cl.
*H04R 7/10* (2006.01)

(52) U.S. Cl. ..... 181/170; 181/167; 181/166; 381/426; 381/431

(58) Field of Classification Search ..... 181/207, 181/290, 167, 170, 164, 166; 188/268; 428/221; 442/181; 523/442; 381/426, 431
See application file for complete search history.

(56) References Cited

U.S. PATENT DOCUMENTS 4,122,314 A * 10/1978 Matsuda et al. ..... 381/425
4,135,601 A * 1/1979 Tsukagoshi et al. ..... 181/167
4,140,203 A * 2/1979 Niguchi et al. ..... 181/167
4,195,713 A * 4/1980 Hagbjer et al. ..... 188/268
4,216,271 A * 8/1980 Takeuchi et al. ..... 428/607
4,346,782 A * 8/1982 Bohm ..... 181/207
4,470,479 A * 9/1984 Inoue et al. ..... 181/168
4,663,224 A * 5/1987 Tabata et al. ..... 442/181
4,690,960 A * 9/1987 Yamauchi et al. ..... 523/442
5,102,729 A * 4/1992 Yamaguchi et al. ..... 442/147
5,259,036 A * 11/1993 Seeler ..... 381/426
5,274,199 A * 12/1993 Uryu et al. ..... 181/169
5,329,072 A * 7/1994 Kageyama et al. ..... 181/167
5,945,643 A * 8/1999 Casser ..... 181/290
6,097,829 A * 8/2000 Guenther et al. ..... 381/425
6,245,419 B1 * 6/2001 Hakotani et al. ..... 428/221
6,453,049 B1 * 9/2002 Chu et al. ..... 381/152
7,030,304 B1 * 4/2006 Harris ..... 84/290
2003/0211282 A1 * 11/2003 Tung-Siang et al. ..... 428/114
2003/0223613 A1 * 12/2003 Hachiya ..... 381/423
2004/0037447 A1 * 2/2004 Kam ..... 381/431

(Continued)

FOREIGN PATENT DOCUMENTS

EP 0 053 498 A 2 6/1982

(Continued)

OTHER PUBLICATIONS

English translation of JP 62-289098, Translated by FLS, Inc., Apr. 2009.*

*Primary Examiner*—Jeffrey Donels
*Assistant Examiner*—Jeremy Luks
(74) *Attorney, Agent, or Firm*—Oblon, Spivak, McClelland, Maier & Neustadt, L.L.P.

(57) ABSTRACT

There is provided an acoustic vibratory plate having at least first to third laminated bodies layered. In the acoustic vibratory plate, the first and third laminated bodies are formed of a polymer material, and the second laminated body is formed of a polymer material different from the polymer material forming the first and third laminated bodies in dynamic internal loss.

7 Claims, 6 Drawing Sheets

U.S. PATENT DOCUMENTS

2004/0112672 A1 * 6/2004 Ono et al. ..... 181/169

FOREIGN PATENT DOCUMENTS

JP 62-289098 12/1987
JP 1-223898 9/1989
JP 2-214888 8/1990
JP 11-241223 9/1999
JP 2002127288 A * 5/2002
JP 2003-107545 4/2003

* cited by examiner

ACOUSTIC VIBRATORY PLATE

CROSS REFERENCES TO RELATED APPLICATIONS

The present document contains subject matter related to Japanese Patent Application JP 2005-109032 filed in the Japanese Patent Office on Apr. 5, 2005, the entire contents of which being incorporated herein by reference.

BACKGROUND OF THE INVENTION

1. Field of the Invention

The present invention relates to an acoustic vibratory plate used in a speaker or the like.

2. Description of Related Art

While a reproduction frequency of an acoustic vibratory plate was about 20 kHz in the past, in recent years, the reproduction of up to about 100 kHz has been enabled with improvement in performance of acoustic equipment. Consequently, the improvement in damping property, which is one of dynamic properties, has been required in an acoustic vibratory plate of a speaker, a headphone or the like.

Hereinafter, properties required of a vibratory plate material are described, taking an acoustic vibratory plate of a speaker for instance. For a vibratory plate material of an acoustic vibratory plate of a speaker, three factors that influence a frequency response of the speaker most are important: (1) high elastic modulus, (2) high internal loss, that is, high damping property, and (3) small density.

Relationships between these properties and a reproduction frequency response of the speaker are shown in FIG. 6. The elastic modulus influences a piston vibration band B1 and the internal loss influences peak-dip of a split vibration band B2. Furthermore, for flattening, a high internal loss, that is, high damping property is required.

More specifically, by making the elastic modulus higher, the piston band B1 is enlarged in a direction X1 in which the frequency becomes larger. Furthermore, by increasing the internal loss, a resonance peak P is reduced in a direction X2 in which a sound pressure becomes lower. In addition, by increasing the damping property, that is, by making the internal loss higher, a curve profile indicating the frequency response becomes smoother, so that the flattening is improved.

Furthermore, the density influences a reproduction sound pressure level. More specifically, by making the density lower, in other words, by making the material more light-weighted, sensitivity (level) is improved in a direction X3 in which the sound pressure becomes higher.

As is clear from FIG. 6, in order to reproduce a high frequency, it is required that a material with a high elastic modulus be used to enlarge the piston band B1 toward the high frequency band side as much as possible.

In the related art reproduction at 20 kHz, there has been used a technique of using a material of as large Young's modulus as possible to enlarge the piston band B1 and setting the split vibration band B2 to 20 kHz or higher so that split vibration does not influence the reproduction.

Furthermore, in order to alleviate the influence of the split vibration, a damping material with a high internal loss such as a damping agent has been applied to a surface of the vibratory plate, by which peak-dip of the split vibration is flattened.

However, in the reproduction at 100 kHz in recent years, it is very difficult to perform the reproduction at 100 kHz with only the piston band B1 and thus, a reproduction technique of using the split vibration band B2 is required, which makes the flattening of peak-dip of the split vibration band B2 critical issue.

In the past, although a method of applying a damping agent has been used in order to flatten the peak-dip, this method of applying the damping agent has only moderately beneficial and does not bring about a sufficient damping property. Therefore, a technique for increasing the damping property that flattens the peak-dip in the split vibration has been sought.

A related art example is disclosed in Japanese Patent Application Publication No. Hei 1-223898, for example.

SUMMARY OF THE INVENTION

It is desirable to provide an acoustic vibratory plate that effectively increases an internal loss and realizes the flattening of peak-dip of a split vibration band.

In order to achieve the forgoing, an acoustic vibratory plate according to an embodiment of the present invention is an acoustic vibratory plate having at least first to third laminated bodies layered. In the acoustic vibratory plate, the first and third laminated bodies are formed of a polymer material, and the second laminated body is formed of a polymer material different from the polymer material forming the first and third laminated bodies in dynamic internal loss.

Furthermore, an acoustic vibratory plate according to an embodiment of the present invention is an acoustic vibratory plate having three or more multiple-laminated bodies layered. In the acoustic vibratory plate, each of the laminated bodies is formed of a first or second polymer material different from each other in dynamic internal loss, and the laminated body formed of the first polymer material and the laminated body formed of the second polymer material are arranged alternately.

The acoustic vibratory plate according to the embodiments of the present invention effectively increases the internal loss and realizes an increase in damping property, thereby realizing the flattening of peak-dip of a split region.

BRIEF DESCRIPTION OF THE DRAWINGS

FIG. 1A is a cross-sectional view in normal times and FIG. 1B is a cross-sectional view showing damping by shear deformation during vibration.

FIG. 2A is a cross-sectional view in normal times and FIG. 2B is a cross-sectional view showing damping by stretching deformation of a damping agent during vibration.

DESCRIPTION OF THE EMBODIMENTS

Hereinafter, an acoustic vibratory plate to which the present invention is applied is described with reference to the drawings.

Figure 1A:
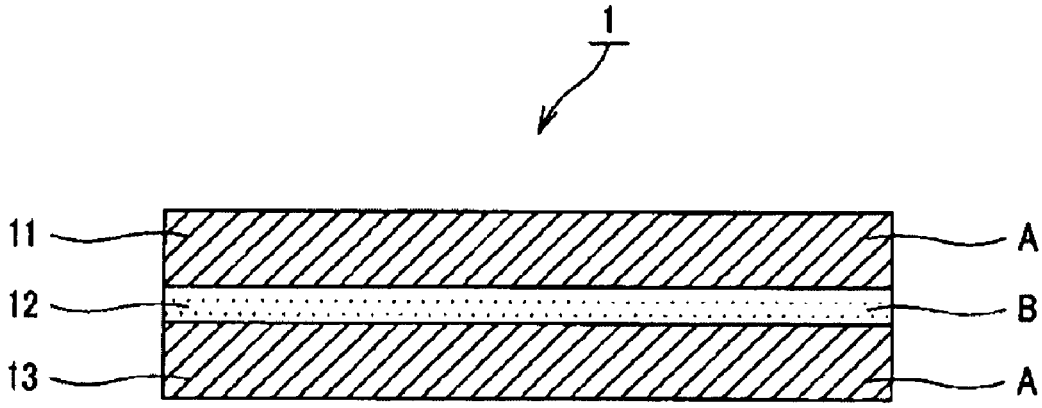
FIG. 1A and FIG. 1B show an acoustic vibratory plate to which the present invention is applied.

In an acoustic vibratory plate 1 to which the present invention is applied, as shown in FIG. 1A, a first laminated body 11, a second laminated body 12 and a third laminated body 13 are layered in order in a thickness direction.

The first laminated body 11 and the third laminated body 13 are made of a polymer material A. Although the first and third laminated bodies 11 and 13 are made of the same material in the present embodiment, they may be made of different materials.

More specifically, as this polymer material A, polyester (PET), polycarbonate (PC), polyethylene naphthalate (PEN), polyether ether keton (PEEK), polypropylene (PP), polymethylpentene (TPX) or the like is used. These polymer materials may be transparent one or opaque one containing filler such as carbon.

Furthermore, the polymer material A containing a polymer alone may be a colored one such as polyimide (PI), polyether imide (PEI), liquid crystal polymer (LCP) or the like.

The second laminated body 12 is formed between the first and third laminated bodies 11, 13, and is made of a damping agent B which is a polymer material with a high damping property. In other words, the second laminated body 12 is made of the damping agent B which is a material with a higher dynamic internal loss than that of the polymer material A forming the first and third laminated bodies 11, 13.

As this damping agent B, a hot-melt, polyester-based adhesive for laminate containing a polyester resin (vylon-300 produced by TOYOBO., LTD) as a main component, a hot-melt film adhesive (Admer film (olefin-based resin) (TOHCELLO CO., LTD) hot-melt film) or the like is used.

In the acoustic vibratory plate 1 constituted as described above, the first to third laminated bodies 11, 12, 13 are layered in the thickness direction, the first and third laminated bodies 11, 13 are formed of the polymer material A, and the second laminated body 12 is formed of the damping agent B, that is, the polymer material with a higher dynamic internal loss than that of the polymer material A. This structure effectively increases the internal loss in the entire three-layered structure and realizes an increase in damping property, thereby realizing the flattening of peak-dip in a split region.

While in the above-described acoustic vibratory plate 1, the first to third laminated bodies 11, 12, 13 are layered to form the three-layered structure, the present invention is not limited to this. There may be employed any acoustic vibratory plate that is made of a multilayer film having a multilayer structure formed by layering three or more multiple-laminated bodies. In the multilayer structure, film materials such as the polymer material A and the damping agent B are layered in such a manner that the adjacent laminated bodies have different properties, that is, different dynamic internal losses. In other words, while in the above description, the acoustic vibratory plate 1 has the three-layered structure formed by layering the materials in the order of A/B/A, an acoustic vibratory plate may have a four-layered structure formed by layering the materials in the order of A/B/A/B, may have a five-layered structure formed by layering the materials in the order of A/B/A/B/A, and may have a further multilayer structure. The multilayer structure is obtained by increasing the laminated bodies in number, for example, by layering three or more multiple-laminated bodies, forming each of the laminated bodies by the first polymer material A or the damping agent B as the second polymer material which have different dynamic internal losses from each other, and arranging the laminated body formed of the first polymer material A and the laminated body formed of the second polymer material B alternately. As a result, the internal loss can be increased because of an effect of shear deformation described later, so that the damping property can be enhanced to the extent of the increased laminated bodies.

A damping mechanism of the acoustic vibratory plate 1 to which the present invention is applied is now described in comparison with a damping mechanism of a related art acoustic vibratory plate by considering respective bending vibrations. A description of the respective damping mechanisms is given in comparison by considering the bending vibrations in reference to FIGS. 1 and 2, in which a polymer material is denoted by A and a damping agent which is a polymer material with a dynamic internal loss different from that of the polymer material A is denoted by B, which compose the acoustic vibratory plate 1 to which the present invention is applied and an acoustic vibratory plate 100 as an comparative example for comparing with the acoustic vibratory plate 1.

Generally, it is known that the bending vibration is a kind of stretching deformation of the materials and that the magnitude of the damping property depends on the internal losses of the materials and the structure by which the material are composed. Namely, if the acoustic vibratory plate is made of only a material with a high internal loss, the damping property is high. On the other hand, in the case where the laminated bodies made of the polymer material A and the damping agent B which are different kinds of materials are layered as in the acoustic vibratory plate 1 of the embodiment of the present invention, this layered structure largely influences the damping property.

Next, the acoustic vibratory plate 100 according to the comparative example for comparing with the acoustic vibratory plate 1 to which the present invention is applied, which has a three-layered structure as shown in FIG. 1A, is described in reference to FIG. 2.

Figure 2A:
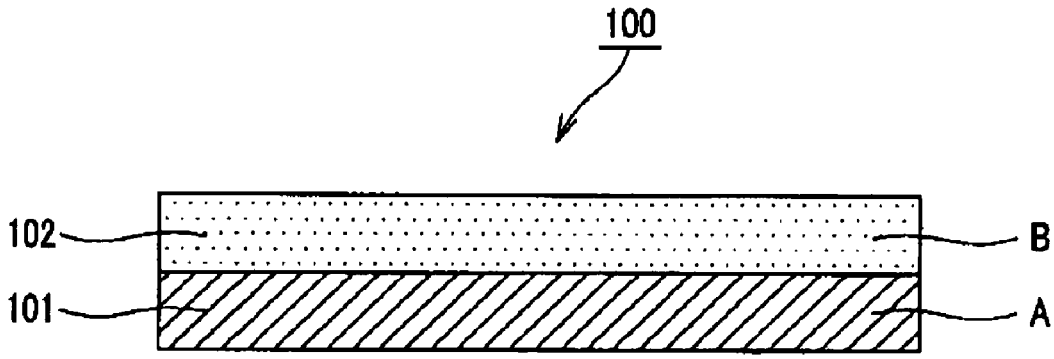
FIG. 2A and FIG. 2B show a related art acoustic vibratory plate.

The acoustic vibratory plate 100 of the comparative example, as shown in FIG. 2A, has a two-layered structure in which a first laminated body 101 made of the polymer material A and a second laminated body 102 made of the damping agent B are layered in the thickness direction. In other words, the damping agent B is applied to the first laminated body 101 to thereby make up the acoustic vibratory plate 100.

Figure 2B:
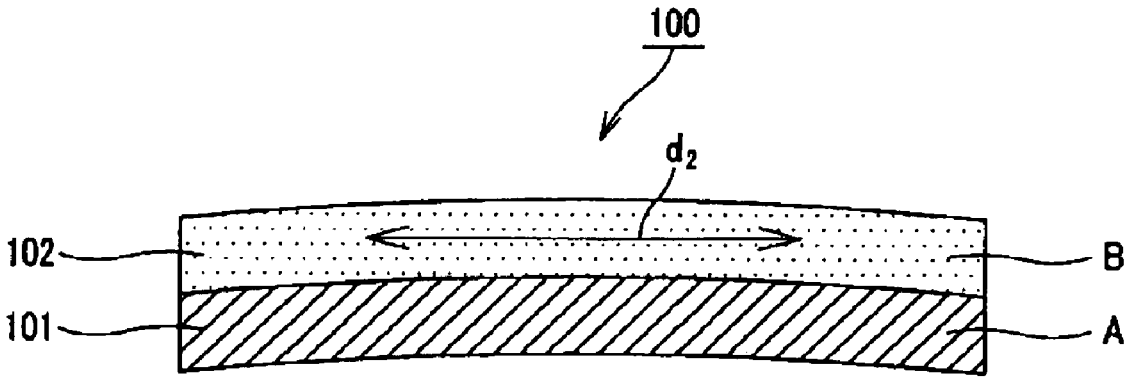

The acoustic vibratory plate 100 has the two-layered structure as shown in FIG. 2A, and the damping mechanism of this two-layered structure is implemented by energy absorption by stretching deformation of the damping agent B with a high internal loss. More specifically, as shown in FIG. 2B, the energy absorption is performed by the damping agent B being stretched to deform in a direction d2 during vibration.

Figure 1B:
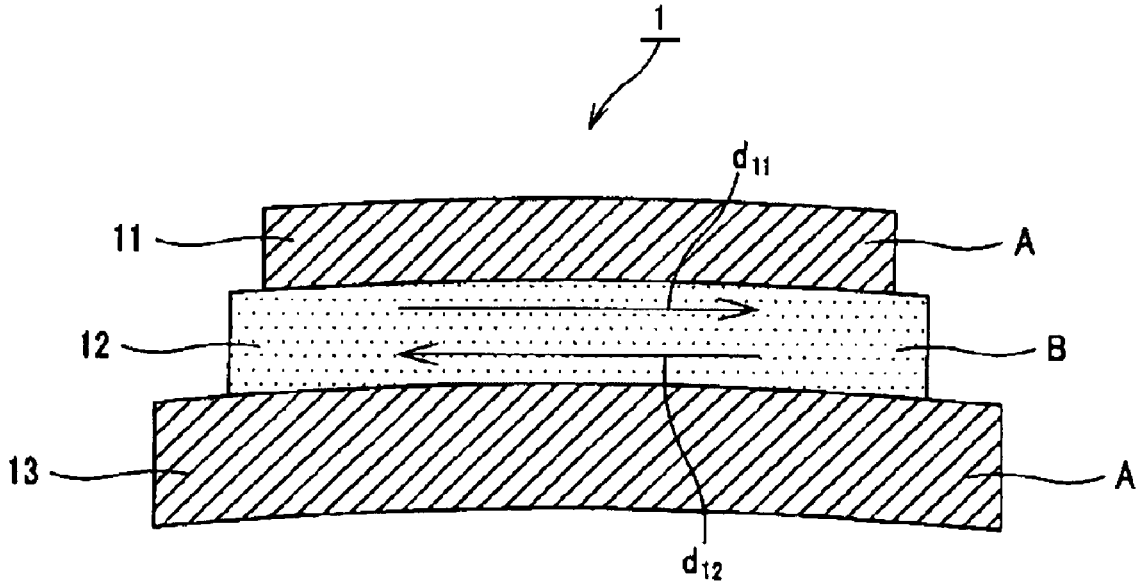

Meanwhile, the acoustic vibratory plate 1 to which the present invention is applied has the three-layered structure as shown in FIG. 1A, and in a damping mechanism of the three-layered structure, deformation in a shear direction, that is, shear deformation occurs with bending in the damping agent B, i.e., the second laminated body 12, formed between the first and third laminated bodies 11, 13 made of the polymer material A. Energy absorption by the shear deformation of the damping agent B of the second laminated body 12 at this time brings about damping. In other words, during vibration, the damping agent B is shear-deformed in directions d11, d12 as shown in FIG. 1B, by which the energy absorption is performed.

More specifically, the damping agent B being the second laminated body 102 of the acoustic vibratory plate 100 is stretch-deformed while the damping agent B being the second laminated body 12 of the acoustic vibratory plate 1 to which the present invention is applied is shear-deformed. In short, the forms of the deformation occurring in the respective damping agents B are largely different from each other in energy absorption mechanism. The internal loss by the shear deformation in the shear direction by the damping agent B of the acoustic vibratory plate 1 having the three-layered structure is larger than the internal loss by the stretching deformation by the damping agent B of the acoustic vibratory plate 100 having the two-layered structure.

Therefore, in the acoustic vibratory plate 100 of the comparative example, which performs the energy absorption by the stretching deformation, the magnitude of the deformation is proportional to a thickness of the damping agent B. Accordingly, in order to obtain a large damping property, the second laminated body 102 (damping agent B) needs to be sufficiently thick.

Meanwhile, in the multilayer structure of the acoustic vibratory plate 1 or the like to which the present invention is applied, even fine deformation such as vibration causes shear deformation in the second laminated body 12 and even if a thickness of the second laminated body 12 (damping agent B) is small, large shear deformation occurs. Namely, the energy absorption is large, and thus, the damping performance is large. Such a structure is an effective damping method to fine vibration in the acoustic vibratory plate or the like.

As described above, the acoustic vibratory plate 1 uses the method of applying the nature of the damping agent B as a visco-elastic material to effectively increase the damping property of the acoustic vibratory plate, and by forming the polymer material A and the polymer material B functioning as the damping agent, which make up the vibratory plate, into a laminated complex of not less than three-layered structure of A/B/A, the damping property effectively increases in comparison with the method of applying the damping agent, as in the comparative example, so that the flattening of the peak-dip in a split region is achieved.

In other words, in the acoustic vibratory plate 1 to which the present invention is applied, three or more laminated bodies of the polymer materials are layered in the thickness direction, and the dynamic internal losses of the polymer materials forming the adjacent laminated bodies are different from each other, which effectively increases the internal loss and realizes an increase in damping property, thereby realizing the flattening of peak-dip in a split region.

Furthermore, as compared with the related art constitution in which the damping agent is applied, the acoustic vibratory plate 1 to which the present invention is applied can exert the damping property with a smaller thickness and can, thus, realize a reduction in thickness and a reduction in weight. Furthermore, the acoustic vibratory plate 1 to which the present invention 1 is applied realizes the flattening of peak-dip in a split region, thereby realizing the reproduction at 100 kHz.

Although in the above-described acoustic vibratory plate 1, the acoustic vibratory plate is made up, using only a multilayer film, the present invention is not limited to this. For example, an acoustic vibratory plate may be made up by joining another material on one end side in the thickness direction of the laminated bodies making up the acoustic vibratory plate.

More specifically, for example, a vibratory plate material such as aluminum foil may be formed in such a manner as to be stuck to either of the first and third laminated bodies 11, 13 of the acoustic vibratory plate 1 shown in FIG. 1A. In this case, the alternative material is not limited to aluminum, but other vibratory plate materials may be used. Furthermore, even in the case of the above-described acoustic vibratory plate in which three or more multiple-laminated bodies are layered, another material may be formed on one end side in the thickness direction of the multilayer laminated bodies so as to be joined.

In the acoustic vibratory plate made of the multilayer film with another material joined, similar to the above-described acoustic vibratory plate 1, three or more laminated bodies of the polymer materials are layered in the thickness direction and the respective adjacent laminated bodies are formed of the different materials in property (dynamic internal loss), which effectively increases the internal loss and realizes an increase in damping property, thereby realizing the flattening of peak-dip in a split region. In other words, the multilayer film functions as a damping material of the vibratory plate of aluminum or the like. The acoustic vibratory plate can obtain a flatter characteristic without peak-dip than an acoustic vibratory plate made of aluminum alone.

Furthermore, in the acoustic vibratory plate 1 to which the present invention is applied, the multilayer structure composed of three or more layers generates a light interference phenomenon and reflected light turns metal glossy color, so that a decorative function of the acoustic vibratory plate can be exerted. More specifically, in the acoustic vibratory plate to which the present invention is applied, the polymer material A and the damping agent B, which make up the laminated bodies formed into the multilayer structure composed of three or more layers, have different refractive indexes from each other, and differentiating them in thickness can allow different light interference phenomena to be generated. This arises from a mechanism in which an optical path difference is generated according to wavelength, and an incident angle varies according to view angle, so that specific phases are synchronized.

EXAMPLES

Hereinafter, more specific Examples 1 to 5 of the acoustic vibratory plate to which the present invention is applied are described.

Example 1

Using a biaxially stretched polyester film (hereinafter, referred to as "PET film") as the polymer material A and a polyester-based adhesive for laminate composed of a polyester resin (hereinafter, referred to as "LA") as the polymer material B which is the damping agent, the properties of the polymer materials A, B were measured, and using the measured values, simulation based on a visco-elastic theory was conducted to compare Comparative Example 1 to which a related art method is applied and Example 1 to which the present invention is applied.

In the comparative simulation, as Example 1 to which the present invention is applied, a three-layered structure in which the laminated bodies were layered in the order of A/B/A, that is, constitution similar to the one shown in FIG. 1A was employed. PET films were used as the polymer material A forming the first and third laminated bodies 11, 13 and were formed with a thickness of 3 microns, respectively, and an LA was used as the damping agent B forming the second laminated body 12, with a thickness of 1 micron to form a complex (of three-layered structure) making up an acoustic vibratory plate. An internal loss of the complex was obtained by the simulation.

Furthermore, Comparative Example 1 for comparing the Example 1 having the above-described constitution was constituted as follows. The acoustic vibratory plate of Comparative Example 1 had a constitution similar to the before-described constitution as shown in FIG. 2A, in which a PET film was used as the polymer material A forming the first laminated body 101 and an LA was used as the damping agent B forming the second laminated body 102 to form a complex (of two-layered structure) making up an acoustic vibratory plate. A thickness of the damping agent B that allows the acoustic vibratory plate of Comparative Example 1 to have an internal loss of the same value as that of the acoustic vibratory plate of Example 1 was obtained by the simulation and thereby, the comparison was performed. By performing this simulation, Example 1 was compared with Comparative Example 1 with respect to usefulness.

In this simulation, the following equation (1) was used as a simulation equation of Example 1 (three-layered structure) to which the present invention is applied.

$$\eta = \frac{-1 + \sqrt{1 - 8\eta_2'^2\{2(a-b)^2 - (a-b)\}}}{4a\eta_2'^2} \tag{1}$$

In the equation (1):

η: An internal loss of the three-layered structure

η2': An internal loss of LA a: A ratio of an elastic modulus of LA to an elastic modulus of PET (elastic modulus of LA/elastic modulus of PET)

ξ: A ratio of a thickness of LA to a thickness of PET (thickness of LA/thickness of PET).

In addition, b satisfies the following equation (2).

$$b = \frac{1}{6(1+\xi)^2} \tag{2}$$

Furthermore, in Comparative Example 1 of two-layered structure, ξ (thickness of LA/thickness of PET) indicating a ratio of a thickness of LA to a thickness of PET that is necessary for satisfying the internal loss of the three-layered structure given by the above-described equation (1) can be given by the following equation.

$$\xi = \frac{-(5aA - 3a) - \sqrt{(5aA - 3a)^2 - 4A(4a^2A + 6aA - 6a)}}{2(4a^2A + 6aA - 6a)} \tag{3}$$

In the equation (3):

A: a ratio of the internal loss of the three-layered structure to the internal loss of LA (internal loss of three-layered structure/internal loss of LA (η/η2')).

The equation (3) gives a thickness ratio of the respective layers in the related art two-layered structure in order to obtain the same loss coefficient as that of the three-layered structure, and thus, cannot be calculated if the internal loss of the three-layered structure, which are indicated by the above-described equations (1), (2), cannot be given. Namely, by using the value of the internal loss of the three-layered structure, the thickness ratio of the two-layered structure can be calculated.

The elastic modulus and the internal loss of the PET and LA in each of the above-described Example 1 and Comparative Example 1 shown in "Table 1" below are used.

TABLE 1

| | PET | LA |
|---|---|---|
| ELASTIC MODULUS(GPa) | 5.0 | 0.4 |
| INTERNAL LOSS tanθ | 0.01 | 0.5 |

From the calculation of the above-described equations (1) to (3) based on property values indicating in "Table 1", it is found that in Example 1 to which the present invention is applied, a total of thickness of A of the three-layered structure of A/B/A, that is, the PET films is 6 microns. In Comparative Example 1, if the thickness of the PET film is 6 microns, it is found from the calculation of the above-described equations (1) to (3) based on the property values indicating in "Table 1" that the thickness of the LA of the damping agent B needs to be 3 microns. In contrast, the thickness of the LA of the damping agent B of Example 1 is 1 micron as described above.

Thus, in the acoustic vibratory plate of Example 1 to which the present invention is applied, the similar internal loss can be obtained even when the thickness of the LA used as the damping agent B is ⅓ of the related art shown in Comparative Example 1, which enables a reduction in weight required of an acoustic vibratory plate.

Example 2

In Example 2, a three-layered structure in which the laminated bodies were layered in the order of A/B/A, that is, constitution similar to the constitution as shown in FIG. 1A was employed. PET films were used as the polymer material A forming the first and third laminated bodies 11, 13 and were formed with a thickness of 25 microns, respectively, and an LA was used as the damping agent B forming the second laminated body 12, and was formed with a thickness of 10 microns to form a complex (of three-layered structure) making up an acoustic vibratory plate. For the complex of Example 2 formed in such a manner, an internal loss was obtained by a vibration reed method.

As Comparative Example 2, a two-layered structure in which the laminated bodies were layered in the order of A/B, that is, constitution similar to the constitution shown in FIG. 2A was employed. As the polymer material A forming the first laminated body 101, a PET film was used similar to the polymer material A of Example 2 and was formed with the same thickness as a total thickness of Example 2, that is, thickness of 50 microns, and as the damping agent B forming the second laminated body 102, similar to the damping agent B of Example 2, an LA was used and, based on the simulation result of Example 1, was applied at 30 microns which is three times the thickness of Example 2 to form a complex (of two-layered structure) making up an acoustic vibratory plate.

The results obtained by measuring internal losses of the complexes of Example 2 and Comparative Example 2 in the vibration reed method are shown in "Table 2" below.

TABLE 2

| | EXAMPLE 2 | COMPARATIVE EXAMPLE 2 |
|---|---|---|
| INTERNAL LOSS tanδ | 0.09 | 0.08 |

As shown in "Table 2", in the complexes of the polymer material A and the damping agent B, in the case of the polymer material A having the similar thickness, it was confirmed that in Example 2, the thickness of the LA used as the damping agent B necessary for obtaining a similar internal loss was only about ⅓ of that of Comparative Example 2 which was constituted in the related art. Furthermore, the result of the simulation of Example 1 could be verified and it was confirmed that this simulation was valid in using for an acoustic vibratory plate.

Example 3

In Example 3, a Balance Dome Tweeter (hereinafter, referred to as "Tw") with a diameter of 25 mm was manufactured using the complex having the three-layered structure constituted in Example 2, and its reproduction frequency response was measured.

Furthermore, in order to compare with Example 3, as Comparative Example 3-1, a Balance Dome Tw with a diameter of 25 mm was manufactured similar to Example 3, using the complex having the two-layered structure constituted in the above-described Comparative Example 2. Furthermore, as Comparative Example 3-2, a Balance Dome Tw with a diameter of 25 mm was manufactured similar to Example 3, using a PET film alone of 50 microns.

Figure 3:
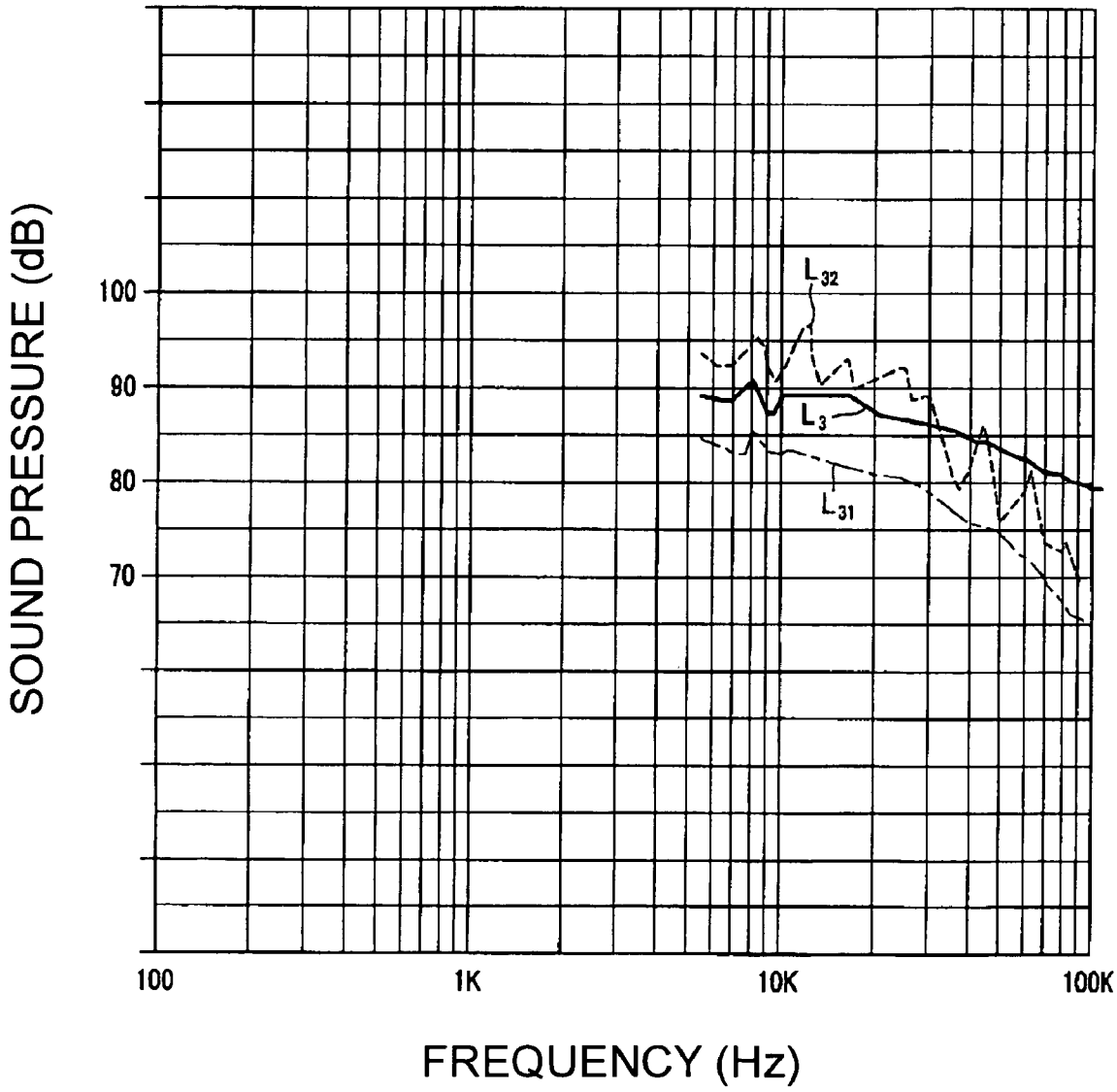
FIG. 3 is a characteristic chart showing relationships between a reproduction frequency response of an acoustic vibratory plate according to Example 3 and reproduction frequency responses of acoustic vibratory plates of Comparative Examples 3-1, 3-2.

FIG. 3 shows the results obtained by measuring reproduction frequency responses of the Tw's using the complexes of Example 3, and Comparative Examples 3-1, 3-2. In FIG. 3, L3 indicates the reproduction frequency response of Example 3, L31 indicates the reproduction frequency response of Comparative Example 3-1, and L32 indicates the reproduction frequency response of Comparative Example 3-2.

As is clear from FIG. 3, the Tw's using an acoustic vibratory plate of Example 3 to which the present invention is applied and an acoustic vibratory plate of Comparative Example 3-1 with the related art structure show less peak-dip at frequencies of 20 kHz or higher. On the other hand, the Tw of Comparative Example 3-2 made of only the PET film has large peak-dip. Furthermore, as for a sound pressure level (SPL), Example 3 to which the present invention is applied and Comparative Example 3-2 of the PET alone is at the same level.

The acoustic vibratory plate of Example 3 to which the present invention is applied shows a characteristic that peak-dip in a high frequency band becomes less and the sound pressure level becomes high. This characteristic is attributed to an effect of obtaining a higher internal loss with a thickness of the damping agent composed of less LA than the related art method and a reduction in weight of the vibratory plate due to the small thickness of the damping agent. Accordingly, it was confirmed that the present invention was a technique that effectively works on an acoustic vibratory plate.

Example 4

In Example 4, a fifteen-layered structure in which the laminated bodies were layered in the order of A/B/A/B . . . B/A was employed. In the structure, 1st to 15th laminated bodies were layered. PET films were used as the polymer material A forming the 1st, 3rd, 5th, 7th, 9th, 11th, 13th, and 15th laminated bodies and were formed each with a thickness of 3 microns, and LA's were used as the damping agent B forming 2nd, 4th, 6th, 8th, 10th, 12th and 14th laminated bodies each with a thickness of 1 micron to form a complex having the fifteen-layered structure making up an acoustic vibratory plate. Using this complex, a Tw similar to that of Example 3 was produced and its reproduction frequency response was measured.

Figure 4:
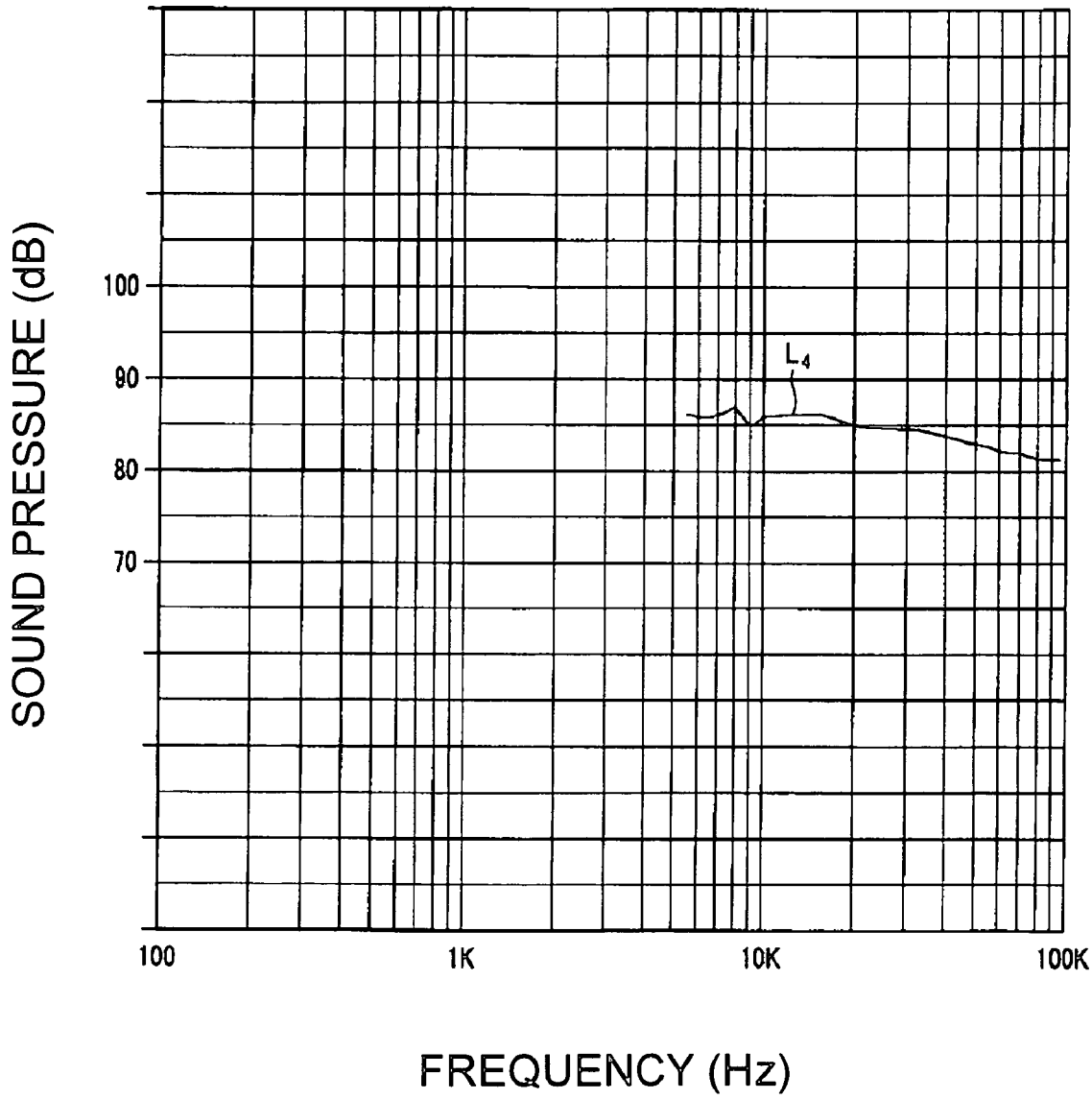
FIG. 4 is a characteristic chart showing a reproduction frequency response of an acoustic vibratory plate according to Example 4.

FIG. 4 shows the results obtained by measuring the reproduction frequency response of the Tw using the complex of the fifteen-layered structure of Example 4. In FIG. 4, L4 indicates the reproduction frequency response of Example 4. Similar to Example 3 indicated by the curve L3 in FIG. 3, L4 has less peak-dip at 20 kHz or higher, which makes it clear that the constitution having the multilayer structure in which three or more laminated bodies are layered effectively can increase the internal loss, and increase the damping property, so that the flattening of the peak/dip of a split region is realized. Accordingly, the usefulness of the present invention was made clear.

Also, it was confirmed that the complex film produced in Example 4 generated a light interference phenomenon and reflected light turned a metal glossy color and could be used for decoration of the vibratory plate.

Example 5

Example 5 is intended to confirm a combined effect of the above-described multilayer film and another material. More specifically, in Examples 3, 4, the effectiveness of the acoustic vibratory plates was examined using only the multilayer film composed of A and B. In Example 5, aluminum foil was joined as another material on one end side in the thickness direction of the first to fifth laminated bodies which were layered in the order of A/B/A/B/A to form the five-layered structure. PET films were used as the polymer material A forming the first, third and fifth laminated bodies and were formed each with a thickness of 3 microns. LA's were used as the damping agent B forming the second and fourth laminated bodies and were formed each with a thickness of 1 micron. On either the first or fifth laminated body, the aluminum foil with a thickness of 35 microns was formed to form a complex acoustic vibratory plate. A Tw similar to the above-described Example 3 was produced and its reproduction frequency response was measured.

Furthermore, as Comparative Example 5 for comparing with this Example 5, a Tw similar to Example 5 was produced using an acoustic vibratory plate formed of aluminum alone and its reproduction frequency response was measured.

Figure 5:
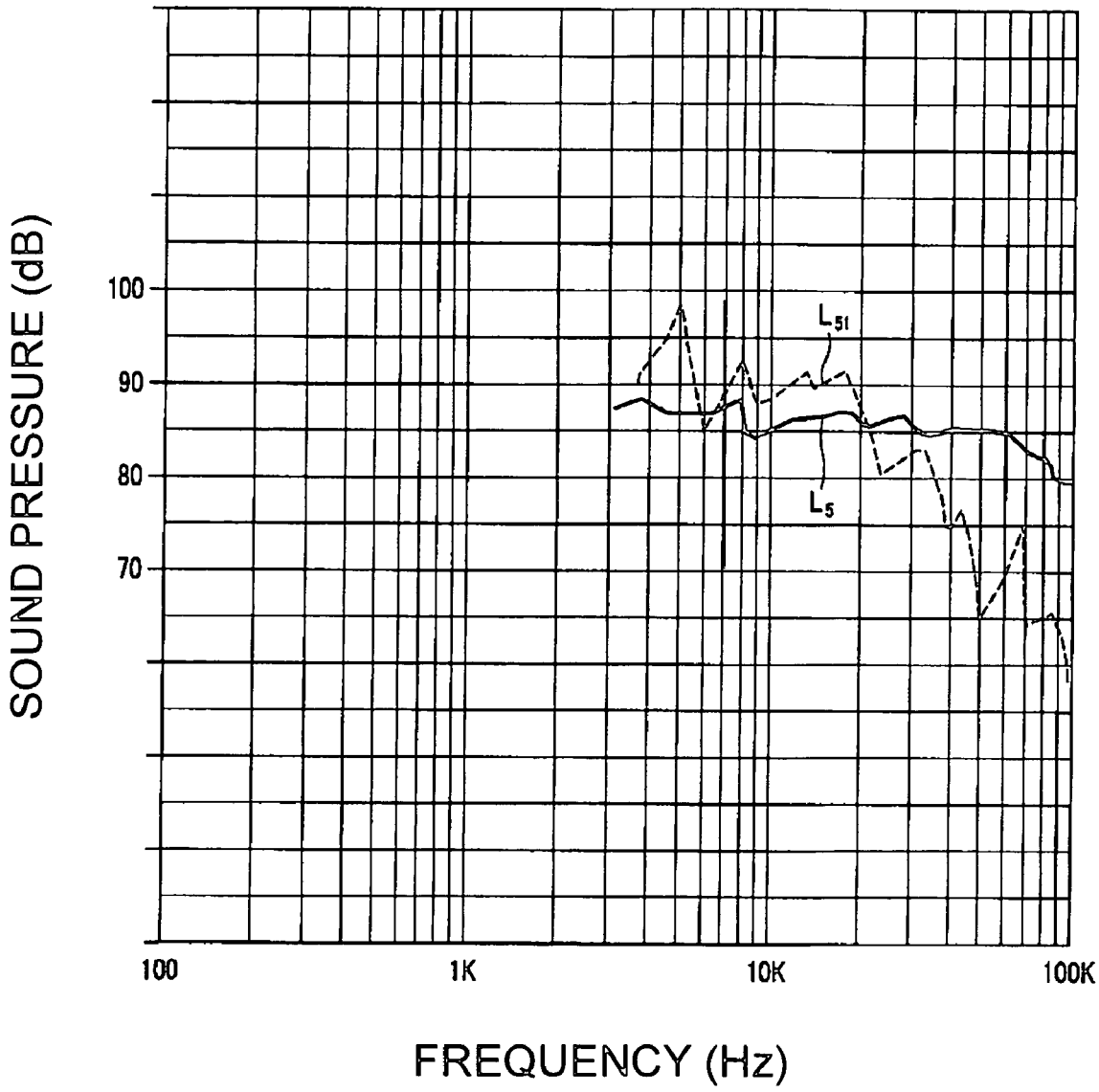
FIG. 5 is a characteristic chart showing a relationship between a reproduction frequency response of an acoustic vibratory plate according to Example 5 and a reproduction frequency response of an acoustic vibratory plate of Comparative Example 5.
Figure 6:
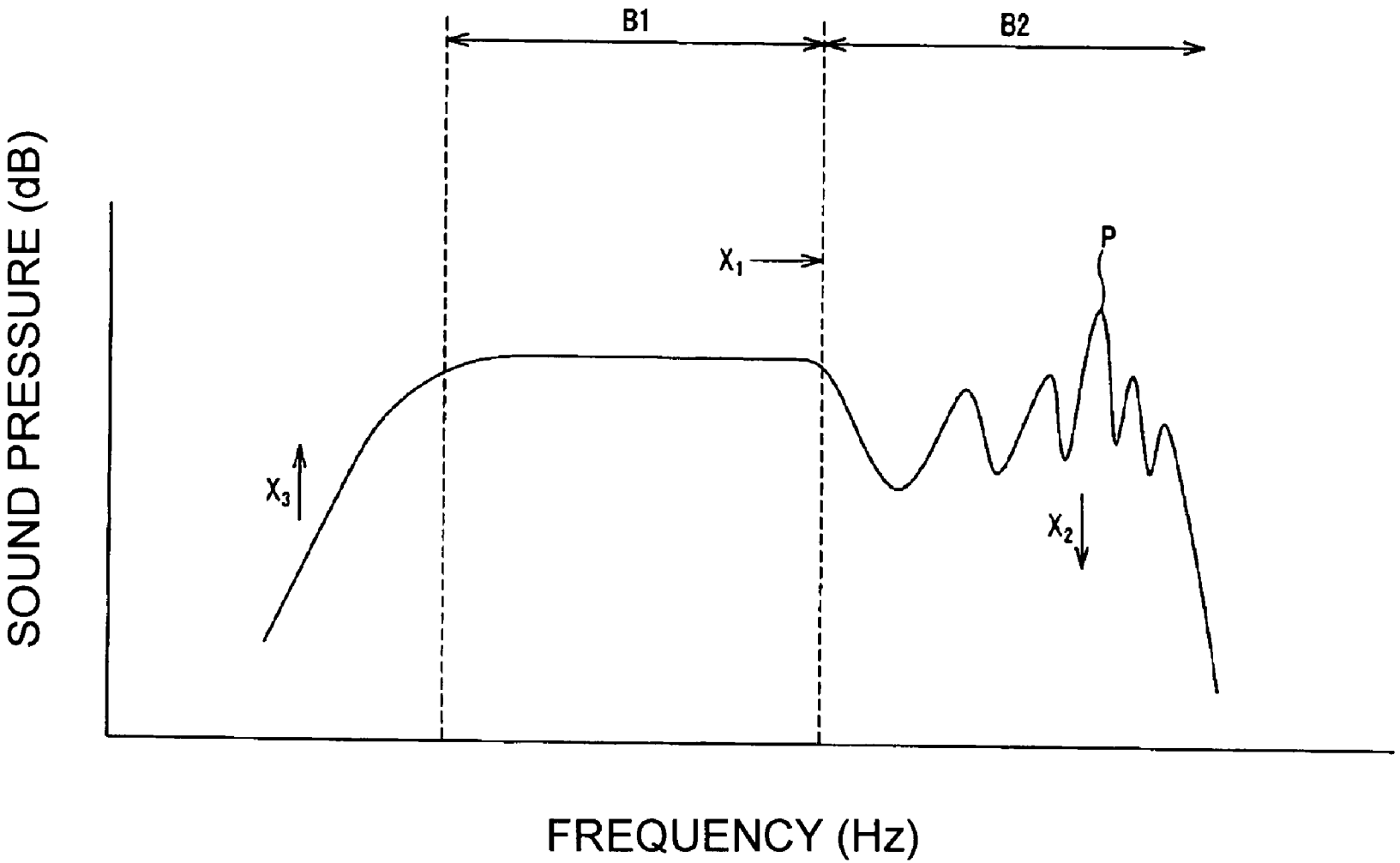
FIG. 6 is a chart showing relationships of a reproduction frequency response of a related art acoustic vibratory plate.

FIG. 5 shows the results obtained by measuring reproduction frequency responses of the Tw's using the complex with the aluminum foil joined and the aluminum vibratory plate of Example 5 and Comparative Example 5, respectively. In FIG. 5, L5 indicates a reproduction frequency response of Example 5, and L51 indicates a reproduction frequency response of Comparative Example.

The characteristic of the acoustic vibratory plate of Comparative Example 5 made of aluminum alone has large peak-dip, while the acoustic vibratory plate of Example 5 to which the present invention is applied shows a flat characteristic without peak-dip, largely exerting the effect.

A method for producing the multilayer laminated bodies is not limited to these examples only but an efficient manufacturing method of a multilayer film and equipment in a related art may be used, and the kinds of materials of the polymer material A and the damping agent B and the constituted thickness are not limited to the above-described examples, either.

Furthermore, with respect to the dynamic internal loss of the materials, although in the above-described Examples 1 to 5, the constitution in which using the LA as the damping agent B having a higher internal loss than that of the PET film of the polymer material A, the laminated bodies were layered in the order of A/B/A was described, a constitution in which four or more laminated bodies were layered in the order of B/A/B/A in a multilayer structure may be employed.

Furthermore, in Example 5, although a description was given using the aluminum vibratory plate having low internal loss because the effect of the present invention is easily exerted, "another material" which is joined on one end side in the thickness direction of the laminated bodies is not limited to aluminum but may be a typical material used in another acoustic vibratory plate.

The acoustic vibratory plate to which the present invention is applied has the three or more laminated bodies, which effectively increases the internal loss of the acoustic vibratory plate, so that peak-dip of a split vibration band can be flattened.

Accordingly, the acoustic vibratory plate to which the present invention is applied is effective especially when used for a speaker that reproduces a high frequency band of 20 kHz or higher. Also, in the acoustic vibratory plate to which the present invention is applied, the laminated bodies made of the polymer materials composing the acoustic vibratory plate can increase the damping property and can obtain metal gloss, which can improve its decorative property.

It should be understood by those skilled in the art that various modifications, combinations, sub-combinations and alterations may occur depending on design requirements and other factors insofar as they are within the scope of the appended claims or the equivalents thereof.

What is claimed is:

1. An acoustic vibratory plate, comprising:

at least first, second and third laminated bodies layered, wherein said first and third laminated bodies are formed of a biaxially stretched polyester (PET) film, said second laminated body is formed of a polyester-based adhesive for laminates composed of a polyester resin (LA) and is a polymer material higher than the polymer material forming said first and third laminated bodies in dynamic internal loss, a thickness of each of the first and third laminated bodies is greater than a thickness of the second laminated body, said first, second, and third laminated bodies generate a light interference phenomenon and exert a decorative function when reflecting light, and a ratio ξ of a thickness of the LA to a thickness of the PET film is defined by the equation:

$$\xi = \frac{-(5aA - 3a) - \sqrt{(5aA - 3a)^2 - 4A(4a^2A + 6aA - 6a)}}{2(4a^2A + 6aA - 6a)},$$

where a is a ratio of an elastic modulus of the LA to an elastic modulus of the PET film and A is a ratio of an internal loss of a structure including the first, second, and third laminated bodies to an internal loss of the LA.

2. The acoustic vibratory plate according to claim 1, wherein another material is joined to either one of said first and third laminated bodies.

3. The acoustic vibratory plate according to claim 1, wherein the first or third laminated bodies are opaque.

4. The acoustic vibratory plate according to claim 1, wherein the first or third laminated bodies are transparent.

5. The acoustic vibratory plate according to claim 1, wherein the internal loss of the structure including the first, second, and third laminated bodies is defined by the equation:

$$\eta = \frac{-1 + \sqrt{1 - 8\eta_2^2\{2(a-b)^2 - (a-b)\}}}{4a\eta_2^2},$$

where $\eta_2'$ is the internal loss of the LA, and b is defined by the equation:

$$b = \frac{1}{6(1+\xi)^2}.$$

6. An acoustic vibratory plate, comprising:

four or more multiple-laminated bodies layered, wherein each of the laminated bodies is formed of a first or second polymer material different from each other in dynamic internal loss;

the laminated body formed of said first polymer material and the laminated body formed of said second polymer material are arranged alternately;

the laminated body formed of the second polymer material has a higher dynamic internal loss than the laminated body formed of said first polymer material;

said first polymer film is a biaxially stretched polyester (PET) film;

said second laminated body is a polyester-based adhesive for laminates composed of a polyester resin (LA);

said four or more multiple-laminated bodies generate a light interference phenomenon and exert a decorative function when reflecting light; and a ratio ξ of a thickness of the LA to a thickness of the PET film is defined by the equation:

$$\xi = \frac{-(5aA - 3a) - \sqrt{(5aA - 3a)^2 - 4A(4a^2A + 6aA - 6a)}}{2(4a^2A + 6aA - 6a)},$$

where a is a ratio of an elastic modulus of the LA to an elastic modulus of the PET film and A is a ratio of an internal loss of a structure including the four or more laminated bodies to the internal loss of the LA.

7. The acoustic vibratory plate according to claim 6, wherein another material is joined on one end side of said multiple-laminated bodies.

* * * * *